US012274383B2

(12) United States Patent
Kunst

(10) Patent No.: US 12,274,383 B2
(45) Date of Patent: Apr. 15, 2025

(54) TEMPORARILY MUTUALLY CONNECTABLE CUPS FOR EFFICIENTLY SERVING DRINKS AND FOOD

(71) Applicant: David Immanuël Kunst, Rijssen (NL)

(72) Inventor: David Immanuël Kunst, Rijssen (NL)

( * ) Notice: Subject to any disclaimer, the term of this patent is extended or adjusted under 35 U.S.C. 154(b) by 40 days.

(21) Appl. No.: 17/114,949

(22) Filed: Dec. 8, 2020

(65) Prior Publication Data

US 2021/0177172 A1 Jun. 17, 2021

(30) Foreign Application Priority Data

Dec. 12, 2019 (EP) ..... 19075018

(51) Int. Cl.

| | |
|---|---|
| ***A47G 19/08*** | (2006.01) |
| ***A47G 19/06*** | (2006.01) |
| ***A47G 19/22*** | (2006.01) |
| ***A47G 19/23*** | (2006.01) |

(52) U.S. Cl.

CPC ..... *A47G 19/08* (2013.01); *A47G 19/06* (2013.01); *A47G 19/2227* (2013.01); *A47G 19/23* (2013.01)

(58) Field of Classification Search

CPC .... A47G 19/08; A47G 19/06; A47G 19/2227; A47G 19/23; B65D 21/0201; B65D 21/0202; B65D 21/0204; B65D 25/28; B65D 25/22; B65D 23/003

USPC ..... 220/574, 23.6, 756, 755

See application file for complete search history.

(56) References Cited

U.S. PATENT DOCUMENTS

| | | | | |
|---|---|---|---|---|
| D165,782 | S * | 1/1952 | Parker | D7/533 |
| 2,597,468 | A * | 5/1952 | Garrett | A47J 47/00 141/363 |
| 3,194,426 | A | 7/1965 | Brown, Jr. | |
| 4,220,079 | A * | 9/1980 | Sims | A47G 19/22 206/0.5 |
| 4,867,330 | A | 9/1989 | Venne | |
| 5,024,067 | A | 6/1991 | Maier | |
| 5,222,622 | A | 6/1993 | Laske, Jr. | |
| D720,573 | S * | 1/2015 | Pola | D7/396.2 |
| 9,038,826 | B2 | 5/2015 | Cocci | |

FOREIGN PATENT DOCUMENTS

| | | | |
|---|---|---|---|
| CN | 201920318 | U | 8/2011 |
| CN | 201920350 | U | 8/2011 |
| CN | 201958471 | | 9/2011 |
| CN | 107550185 | A | 1/2018 |
| DE | 102007053683 | A | 5/2009 |
| NL | 1027288 | C2 | 4/2006 |
| WO | 2011/157851 | A1 | 12/2011 |
| WO | WO2012/045061 | A2 | 4/2012 |

* cited by examiner

*Primary Examiner* — Andrew D Perreault

(74) *Attorney, Agent, or Firm* — Jordan IP Law, LLC; Todd A. Vaughn

(57) ABSTRACT

Temporarily mutually connectable cups for efficiently serving all kinds of beverages and foods such as granular food, crisps, sauces, soup, and yoghurt. The cups have special fully integrated hook elements in the cup wall or on the handles with stabilizing thumb holding parts and the wall (2) has a thickness d. With the integrated hook elements several surrounding cups are temporarily mutually connected with a central cup to form a group of serving cups, facilitating the carrying of the cups by a waiter or waitress.

16 Claims, 4 Drawing Sheets

TEMPORARILY MUTUALLY CONNECTABLE CUPS FOR EFFICIENTLY SERVING DRINKS AND FOOD

The present invention concerns cups, mugs or bowls which are temporarily mutually connectable for efficiently serving drinks and food to a group of people, wherein said drinks are all kinds of beverages and said food is mostly granular food, crisps, sauces, soup or yoghurt etc., wherein said cups, mugs or bowls have a straight, staggered or tapered cylindrical shape in vertical direction, wherein said cups, mugs or bowls are provided with or without a handle.

BACKGROUND OF THE INVENTION

The state of the art does not include an effective way to serve large groups of people with cups, mugs or bowls containing drinks or food in bars, outdoor cafes etc. In practice, it is important that one person can serve several people simultaneously with mentioned cups, mugs or bowls. Serving with a tray which contains cups, mugs, bowls, glasses etc. has serious drawbacks, because it requires a tray and properly balancing of the tray.

In the patent application CN 201958471 (U), filed Sep. 7, 2011, inventor/applicant Yonglin WEN is represented a utility model for a connectable cup. Said cup consists of a handle, which connects with a groove in the next cup. So, you can connect a row of cups or mugs into a long row or line. This invention has a serious drawback because cups or mugs filled with a liquid can only be lined up to two or three cups, due to the bending strength of the connections. The connection cannot be constructed strong enough to line up more cups. So, in this case, the well-known serving tray is the solution. Lined-up cups or mugs cannot really be served out. Therefore, this solution is not usable in practical serving activities.

In the patent application CN107550185(A) connectable cups for lining-up are also described and it has the same drawback for serving a group of people.

OBJECT OF THE INVENTION

The aim of this invention is to overcome the described drawbacks and to provide a very good usable solution with temporarily mutually connectable cups for efficiently serving drinks and food to a group of people, who sit or stand together, in a very efficient way.

SUMMARY OF THE INVENTION

The cups or mugs executed for temporary mutual connection are characterized in that for temporary mutual connection said cups possess a hook element, which hook element is integrated in the wall of the cups or which hook element is integrated in the handle of the cups, wherein said hook element has a horizontal width B and a vertical length L, wherein the wall of the cup has a thickness d, wherein the open part of the horizontal cross section of the hook element has a width D, wherein said width D>d, wherein said open cross section (43) and the handle (51,52) of the cups, mugs or bowls (11,12) have a curvature that corresponds with the curvature of said walls (2) of the cups, mugs or bowls with a thickness d, wherein several cups, mugs or bowls are connected temporarily and grouped around the circumference of one of the cups, mugs or bowls for serving out efficiently.

The advantage is a very usable cup, which proves to be more efficient, time saving and causes less stress for the waiter or waitress. This hook element enables the user to temporarily and mutually connect several cups to and around one single cup. This single cup is placed in the centre of the surrounding cups. Each hook element of each surrounding cup hooks up to the rim of the central cup (see FIG. 10). When lifting only the central cup, all other connected cups will automatically be lifted as well. In this manner, the present invention enables the user to easily pick up, lift, hold, transport and serve several cups, mugs or bowls, with drinks or food at the same time. The user can do this with just one hand and without the need of a serving tray. All the cups, mugs or bowls can be taken in one go. This eliminates the need for going to and from with just a few cups, mugs or bowls. Once the user has taken all the connected cups, mugs or bowls towards the group awaiting their drinks or food, each person can than easily unhook his or hers individual cup, mug or bowl.

Furthermore the cups as claim 1 are characterized in that a thumb holding part is provided on the handle on top of said integrated hook element.

The advantage is a very stable transport of a set of cups, mugs or bowls.

Then the cup, mug or bowl according to the invention is further characterised in that said handles of the cups, mugs or bowls have a massive circular cross section or a U-shaped cross section, which U-shape is preferably tapered in vertical direction and that an integrated hook element is applied at the top of the handles.

The advantage is a very good stackable and temporarily mutually connectable cup, mug or bowl especially for use in (fast food) restaurants or bars or at festivals.

Furthermore, the cup according to the invention is characterized in that the horizontal width B of said wall integrated hook element is between ¼ and 1/10 of the horizontal circumference of the cup wall, preferably being ⅛.

The advantage is a very easy and safe temporary mutual connection of said cups, mugs or bowls.

Then the cup according to the invention is characterized in that the open part of the horizontal cross section of the hook element has a measurement D of about 1,1d and that said length L of said wall integrated hook element is between 1 and 3 times that of said wall thickness d, preferably 2 times.

The advantages are a very suitable and well to loose cup from the central cup.

Furthermore, the cup according to the invention is characterised in that the colour or combination of colours and marks of the cups can be adapted to the company's use and that said cups are provided with a trademark of the contained beverage or said food and that the colour of said cups are adapted for the individual user.

The advantage is a very personal executed cup for companies, beverages, food and individuals.

Then the cup according to the invention is further characterized in that the material of the cups with the integrated hook elements is glass, ceramics, plastic, metal, paper or cardboard.

The advantage is that these cups can be manufactured in different materials to serve one's personal use or taste.

BRIEF DESCRIPTION OF THE DRAWING

The embodiments of the present invention will now be described by way of example with reference to the accompanying drawing with figures, in which.

DETAILED DESCRIPTION

Figure 3:
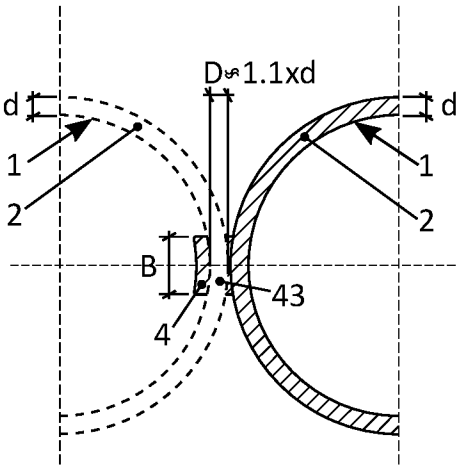
FIG. 3 shows a horizontal cross section over the line III-III of FIG. 1.
Figure 2:
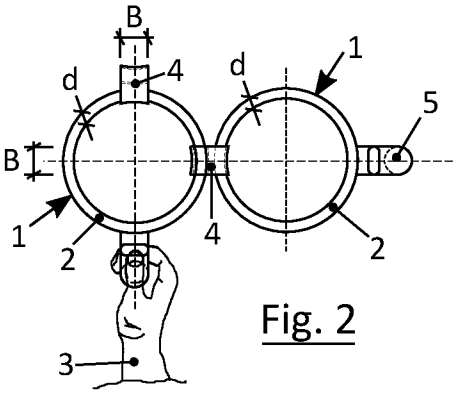
FIG. 2 shows a top view over the line II-II of FIG. 1.
Figure 1:
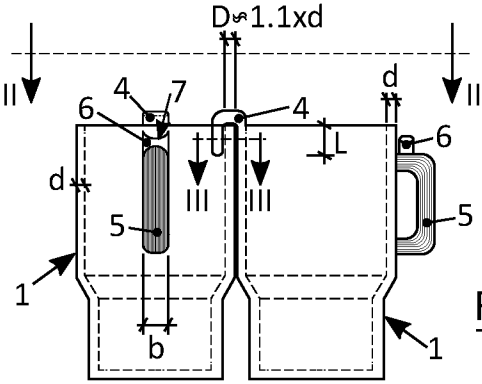
FIG. 1 shows a side view of only two temporarily mutually connected cups according to a first embodiment of the invention with a staggered cylindrical shape completed with a handle.

FIG. 1 represents a side view of one central container or cup 1 with only one other temporarily mutually connected cup 1. Said cups 1,11,12 (See also the other figures) are identical or modular and each have a sidewall 2 with thickness d. The hand 3 of the waiter or waitress lifts the central cups 1,11,12. The temporary mutual connection of the connected cup 1 to the central cup 1 is executed by an integrated hook element 4 with a width B, as shown in FIGS. 2 and 3. The cups 1 have a staggered vertical cylindrical shape and have a handle 5 with a circular cross section with a normal diameter and a thumb holding part 6 at the top executed as a bight portion of the handle 5 as shown in FIG. 1. The open parts of the horizontal cross section of the hook elements 4,41,42 have a measurement of about 1,1d=D as shown in FIG. 3 for sufficient mechanical strength and sufficient disconnection space, wherein d is the sidewall thickness 2 of the cups. The thumb holding part 6, 61 is provided with a recess 7 for an extra stable transport of the central cup 1 with the temporarily mutually connected other cups 1. The width B in FIG. 3 is preferably ⅛ of the horizontal circumference of the cups 1, 2. The length L of the integrated hook element 4 has in practice 2 times the thickness d of the walls of the cups 1,11,12. (Also FIGS. 5 and 6).

Figure 4:
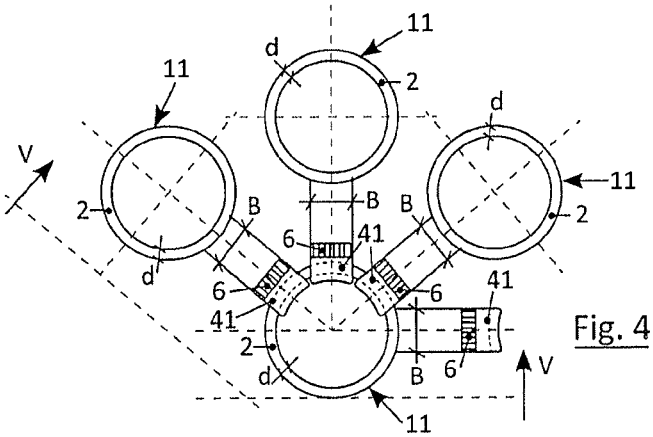
FIG. 4 shows a top view of a central cup and three temporarily mutually connected cups, all cups are provided with a handle with integrated hook element.
Figure 5:
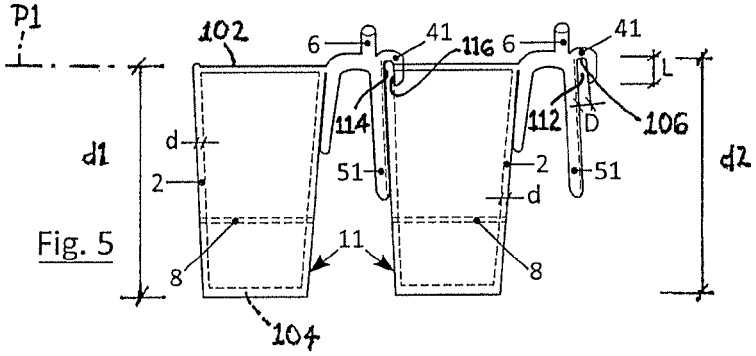
FIG. 5 shows a side view over the line V-V of FIG. 4 of a tapered cylindrical cup with handle with integrated hook element and thumb holding part according to a preferred embodiment of the invention.

In FIG. 4 a modular tapered cylindrical (i.e., conical) container or cup 11 and three other structurally identical and temporarily mutually connected cups 11 are shown. As shown in FIGS. 4 and 5, each cup 11 includes a container body (not separately designated) with sidewall 2 and a bottom panel 71. Sidewall 2 has a rim or lip 73 at an upper end, opposite bottom panel 71. A handle 51 is connected to sidewall 2 at the upper end thereof, near rim or lip 73. The integrated hook element 41 is now integrated in this special handle 51. Hook element 41 is disposed on an outer side of handle 51, opposite container sidewall 2 and extending away from handle 51 and the container sidewall. Hook 51 is configured for receiving lip of another cup and for supporting the container or cup 11 on the lip of the other cup, as shown in FIG. 4.

In FIG. 5 a side view of a central cup 11 with some other cups 11 over the line V-V is shown. The same parts have the same numbers. The value of B, D and L are the same as in the FIGS. 1 to 6. In cups 11 an internal ring 8 is applied for reasons of stacking and pulling out of a container (not shown). As further shown in FIG. 5, cups 11 each have a rim or lip 102 disposed in a plane P1 extending parallel to a bottom panel or base 104 of the cups and located at a distance d1 from the bottom panel or base 104. The integrated hook element 41 has a closed upper end portion (not separately designated) with a lower or inside surface 106 disposed at a distance d2 from bottom panel or base 104. The distances d1 and d2 are equal, as indicated in FIG. 5. The hook 41 is at the same height above the bottom panel or base 104. The integrated hook element 41 defines a slot 112 with two parallel mutually facing surfaces 114, 116 (FIG. 5) and closed at an upper end by lower or inside surface 106. The lower or inside surface 106 of the integrated hook element 41 is disposed between the two parallel mutually facing surfaces 114, 116 and in contiguity with each of the two parallel mutually facing surfaces 114, 116.

Figure 7:
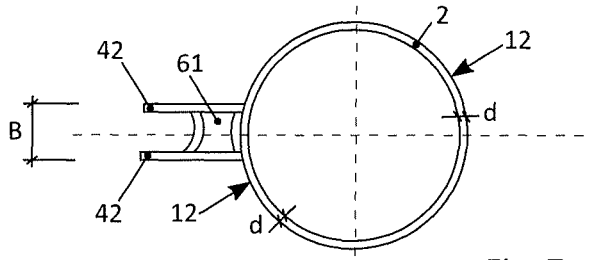
FIG. 7 shows a top view of one conical, or tapered cylindrical, cup over the line VII-VII of FIG. 6.
Figure 8:
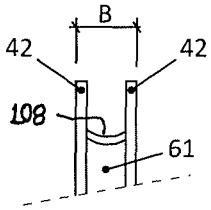
FIG. 8 shows a side view over the line VIII of FIG. 6.
Figure 9:
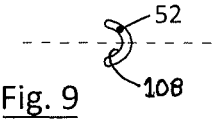
FIG. 9 shows a cross section over the line IX of FIG. 6.
Figure 6:
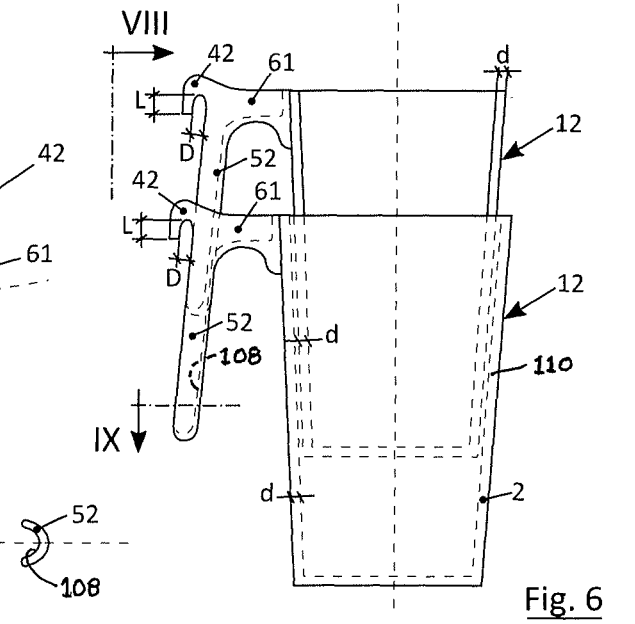
FIG. 6 shows a side view of two tapered cylindrical, that is, conical, cups with an integrated hook element and thumb holding part according to another preferred embodiment of the invention.
Figure 10:
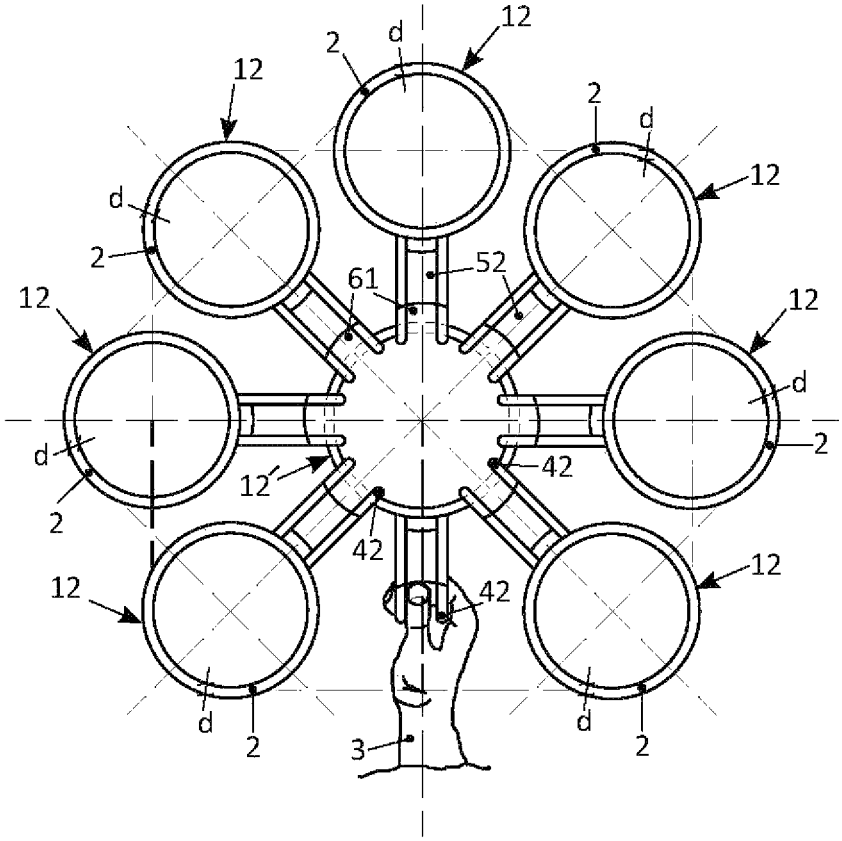
FIG. 10 shows a top view of seven cups temporarily mutually connected to a central cup for easy serving.

In FIG. 6 a side view of two stacked conical, or tapered cylindrical, cups 12 is represented with a special handle 52, which is provided with a modified integrated hook element 42 and an integrated thumb element 61. The cross section of the modified special handle 52 is hollow or U-shaped (FIG. 9) to make the cups (12) stackable, i.e. in a vertical pull-out container (not shown). Alternatively described, the handle 52 has an outer surface 108 (see FIGS. 6-9) facing in a lateral or horizontal direction away from the container body 110, where the outer surface is (i) concave in cross-sectional planes oriented parallel to the bottom panel or base 104, (ii) configured to receive and engage an external lateral surface of a sidewall of a second, modular, container 11 so as to support the container body against the sidewall of the second container, and (iii) specifically configured as an elongate concave surface. More details of the cups 12 are shown in the FIGS. 7, 8 and 9. As illustrated in FIG. 10, the outer surface 108 of the handle 52 of each outer container or cup 12 in a serving or carrying assembly lies against a lateral outer surface of the sidewall 2 of a central container/cup 12'. Handle 52 necessarily has an angle of inclination identical to that of conical sidewall 2. Thus handle 52 extends parallel to a side of sidewall 2 opposite handle 52. In addition, as best seen in FIG. 7, handle 52 has a concave outer surface 75 facing in a lateral or horizontal direction away from the container body and sidewall 2. Concave outer surface 75 engages an external or outer surface of the sidewall of another modular cup 12, particularly, a cup serving as the central cup 12', thereby supporting the one cup against the other. Outer surfaces 108 and 75 are each a cylindrically concave surface with an axis of symmetry extending substantially parallel to a section of the external lateral surface of the respective sidewall 2 on a side of container body 110 opposite the handle 52. The elongate cylindrically concave outer surface 108, 75 has a geometric shape conforming to or congruent with a co-extensive section of the cup sidewall 2, whereby the outer surface 108, 75 receives and conformingly engages the sidewall of another modular cup 12 when connected thereto by means of the integrated hook element 41.

In FIG. 10 a top view of a fully installed or assembled serving system is shown with a central cup 12' and the other temporarily mutually connectable cups 12. The central cup 12' and the mentioned temporarily mutually connectable other cups 12 are identical in their embodiment, as indicated above.

However, is it obvious that modifications and/or additions to the afore described temporarily mutually connectable cups 1,11,12 can be made, but these shall remain within the field and scope of the invention.

The invention claimed is:

1. A container for facilitating serving drinks and food to a group of people, the container comprising:

a container body having a sidewall with a circular rim at an upper end of said container body;

a handle connected to said sidewall and adapted to serve as a handgrip, said handle having an elongate cylindrically concave outer surface on a side of said handle opposite said container body and facing in a lateral or horizontal direction away from the container body, said elongate cylindrically concave outer surface having a geometric shape conforming to or congruent with said sidewall, wherein said handle defines a closed loop together with said sidewall. said handle being connected at both an upper end and a lower end to said sidewall; and a hook element integrated in said handle and disposed on an outer side of said handle opposite said container body and extending away from said handle and said container body, said hook element together with said handle defining a slot with two parallel mutually facing surfaces, said lower or inside surface being disposed between in contiguity with each of said two parallel mutually facing surfaces.

2. The modular container as defined in claim 1, wherein a thumb holding part is provided on said handle.

3. The container as defined in claim 1, wherein said integrated hook element has a horizontal width of between ¼ and 1/10 of a horizontal circumference of said sidewall.

4. The container defined in claim 1, wherein said handle extends parallel to a portion of said sidewall opposite said handle.

5. The container defined in claim 1, wherein said integrated hook element is spaced from said container body and said rim by a bight portion of said handle.

6. The container defined in claim 5, wherein said bight portion is configured as a thumb holding part.

7. The container defined in claim 1, wherein said sidewall is conical and tapers downwardly.

8. The container defined in claim 7, wherein said integrated hook element is spaced from said container body and said rim by a bight portion of said handle.

9. The container defined in claim 8, wherein said bight portion is configured as a thumb holding part.

10. The container as defined in claim 7, wherein a thumb holding part is provided on said handle.

11. The container as defined in claim 7, wherein said integrated hook element has a horizontal width of between ¼ and 1/10 of a horizontal circumference of said sidewall.

12. The container defined in claim 1, wherein the slot has a curvature that corresponds to a curvature and a thickness of the sidewall.

13. A container for facilitating serving drinks and food to a group of people, the container comprising:

a container body having a sidewall having an external lateral surface;

a handle connected to said sidewall extending substantially parallel to a section of said external lateral surface on a side of said container body opposite said handle, wherein said handle defines a closed loop together with said sidewall, said handle being connected at both an upper end and a lower end to said sidewall; and a hook element integrated in said handle and disposed on an outer side of said handle opposite said container body and extending away from said handle and said container body, said hook element together with said handle defining a slot with two parallel mutually facing surfaces, said hook element having a closed upper end with a lower or inside surface facing downwardly, said lower or inside surface being disposed between said two parallel mutually facing surfaces and in contiguity with each of said two parallel mutually facing surfaces.

14. The container defined in claim 13, wherein said integrated hook element is spaced from said container body and said rim by a bight portion of said handle.

15. The container defined in claim 14, wherein said bight portion is configured as a thumb holding part.

16. The container defined in claim 13, wherein the slot has a curvature that corresponds to a curvature and a thickness of the sidewall.

* * * * *